US008250706B2

(12) United States Patent
Vanini

(10) Patent No.: US 8,250,706 B2
(45) Date of Patent: Aug. 28, 2012

(54) HINGE FOR DOORS

(75) Inventor: Angelo Vanini, Bologna (IT)

(73) Assignee: Nuovo Star S.p.A. (IT)

( * ) Notice: Subject to any disclaimer, the term of this patent is extended or adjusted under 35 U.S.C. 154(b) by 718 days.

(21) Appl. No.: 12/222,550

(22) Filed: Aug. 12, 2008

(65) Prior Publication Data

US 2009/0064458 A1 Mar. 12, 2009

(30) Foreign Application Priority Data

Sep. 10, 2007 (IT) ..... BO2007A0614

(51) Int. Cl.
*E05F 1/08* (2006.01)

(52) U.S. Cl. ..... 16/286; 16/277; 16/285; 16/361

(58) Field of Classification Search ..... 16/80, 85, 16/277, 284, 285, 289–292, 297, 287, 357, 16/361, 389, 233, 281, 256, 322, 355; 49/386, 49/387, 389, 398, 402; 126/191, 194
See application file for complete search history.

(56) References Cited

U.S. PATENT DOCUMENTS

| | | | | |
|---|---|---|---|---|
| 3,358,320 | A | 12/1967 | Shaw et al. | |
| 3,450,125 | A * | 6/1969 | Hopkins | 126/191 |
| 3,749,080 | A * | 7/1973 | Kleinhenn | 126/191 |
| 4,658,473 | A * | 4/1987 | Schema | 16/290 |
| 5,025,776 | A * | 6/1991 | Hanley et al. | 126/194 |
| 6,397,836 | B1 * | 6/2002 | Pelletier et al. | 126/194 |
| 6,892,423 | B2 * | 5/2005 | Cheal et al. | 16/289 |
| 6,986,187 | B2 * | 1/2006 | Cummins et al. | 16/286 |
| 7,017,232 | B1 * | 3/2006 | Priddy | 16/286 |
| 2003/0213098 | A1 * | 11/2003 | Cummins et al. | 16/286 |
| 2003/0217436 | A1 * | 11/2003 | Hashim et al. | 16/286 |
| 2004/0231370 | A1 * | 11/2004 | Cheo et al. | 68/3 R |
| 2006/0032019 | A1 * | 2/2006 | Kistner et al. | 16/286 |
| 2006/0053589 | A1 * | 3/2006 | Vanini | 16/286 |
| 2006/0059956 | A1 * | 3/2006 | Zardetto | 68/3 R |

FOREIGN PATENT DOCUMENTS

GB 1 121 380 A 7/1968

* cited by examiner

*Primary Examiner* — Victor Batson
*Assistant Examiner* — Roberta Delisle
(74) *Attorney, Agent, or Firm* — Timothy J. Klima; Shuttleworth & Ingersoll, PLC

(57) ABSTRACT

A hinge for doors, in particular for electrical appliances, comprises a box-shaped body (3), a lever (4) pivoting at the box-shaped body (3) at a respective axis (A) of rotation so that the body (3) and the lever (4) can move relative to each other by tilting, the box-shaped body (3), a spring (12) housed in the box-shaped body (3) and designed to operate in conjunction with a first portion (4*a*) of the lever (4) to adjust the motion of the lever (4) and the box-shaped body (3) relative to each other.

11 Claims, 5 Drawing Sheets

HINGE FOR DOORS

BACKGROUND OF THE INVENTION

The present invention relates to a hinge for doors.

The use of a hinge made in accordance with this invention is particularly advantageous for connecting the door of an electrical appliance which opens at the top to the respective supporting frame, in particular in the case of a washing machine to which express reference is made below, without thereby limiting the scope of the invention.

In top loading washing machines the hinges normally consist of two separate elements, usually at least one having a box-shaped structure, the two elements being kinematically connected to each other.

More precisely, one element is usually fixed to the washing machine supporting frame, at one side of the opening used for loading and unloading, whilst the other element is fixed to one edge of the door, which in this way is rendered movable so that it can tilt relative to the opening.

One of the two elements usually consists of an arm of a rocker lever, pivoting at the other element.

Means for adjusting door opening usually act on the second arm of said lever. Said means may comprise elastic elements and friction elements able to facilitate and/or oppose the door opening-closing movement.

Basically, the function of said means is both to provide an elastic force able to help the user with the effort of lifting the door, and to balance the door, applying a braking action to it, so that dangerous high speeds are not reached during opening or closing.

In current top loading washing machines, there is a need to apply a braking action, that is to say, to balance, the door for most of its opening/closing angle but, as the door is closed, the presence of an electromechanical switch requires significant force to operate it. Until now the two requirements were not satisfied simultaneously: there are hinges which are very balanced, which therefore oblige the user to apply a high level of prolonged force to open/close the door and to activate/deactivate the switch, or hinges which, providing a slight balancing action cause the closing door to acquire a level of motion high enough to activate the switch, therefore with all of the risks linked to a door which gains speed when closing and which can even strike the user. Such a circumstance is a disadvantage of prior art hinges.

SUMMARY OF THE INVENTION

The present invention has for an aim to provide a hinge for wings or doors which is free of the disadvantage described above and which at the same time has a simple structure and practical and effective operation.

The technical features of the present invention, in accordance with the above aim, are clear from the content of the claims herein, in particular claim 1 and, preferably, from any of the claims directly or indirectly dependent on claim 1.

BRIEF DESCRIPTION OF THE DRAWINGS

The advantages of the present invention are more apparent in the detailed description which follows, with reference to the accompanying drawings which illustrate a preferred, non-limiting embodiment of the invention, in which.

DESCRIPTION OF THE PREFERRED EMBODIMENTS

Figure 1:
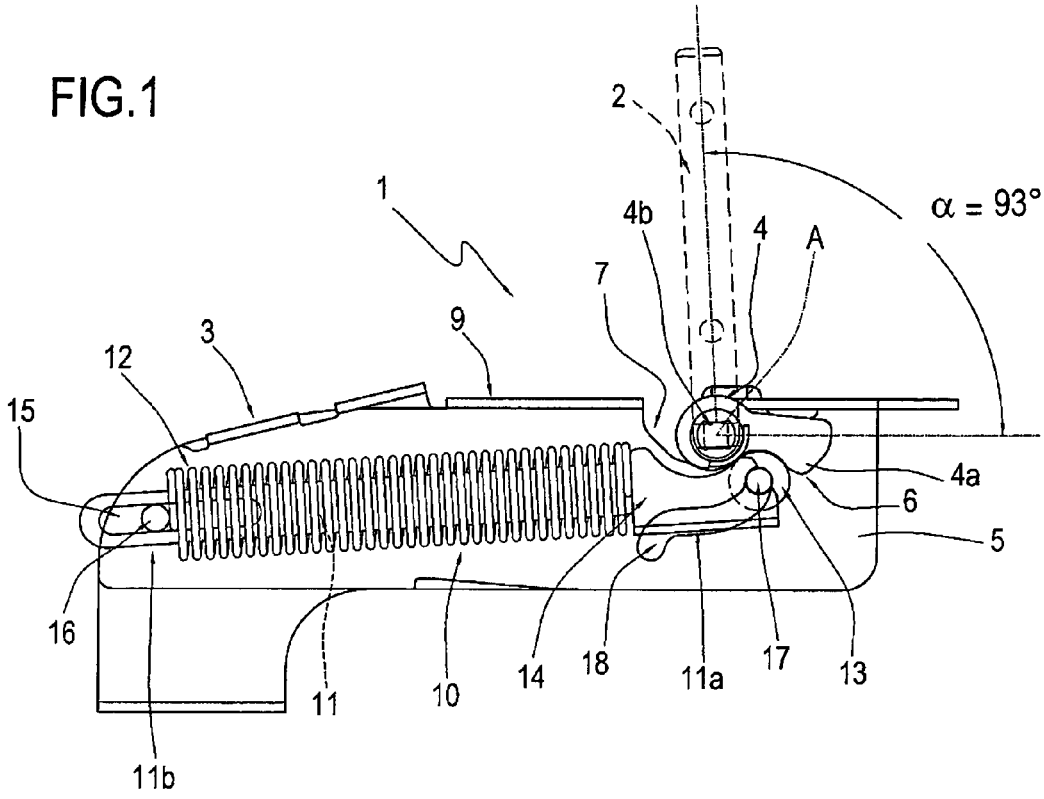
FIGS. 1 to 8 illustrate, in respective side elevation views with some parts in cross-section and others transparent, a preferred embodiment of the hinge for doors in accordance with the present invention, in a succession of configurations for use.
Figure 2:
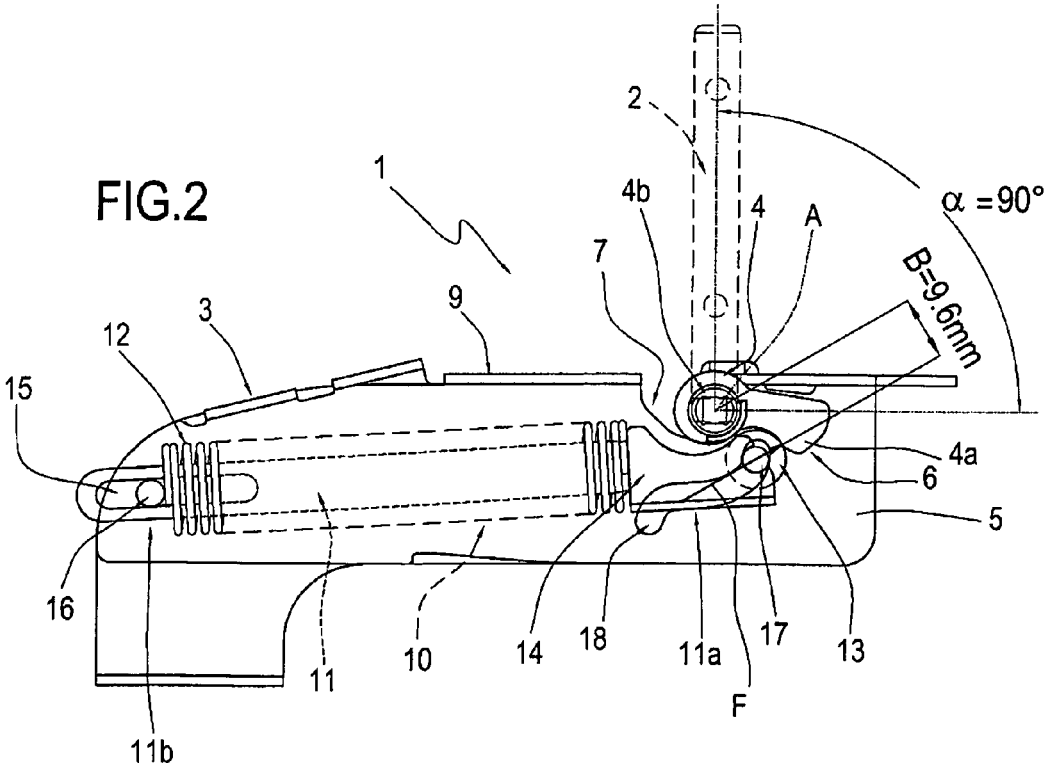
Figure 3:
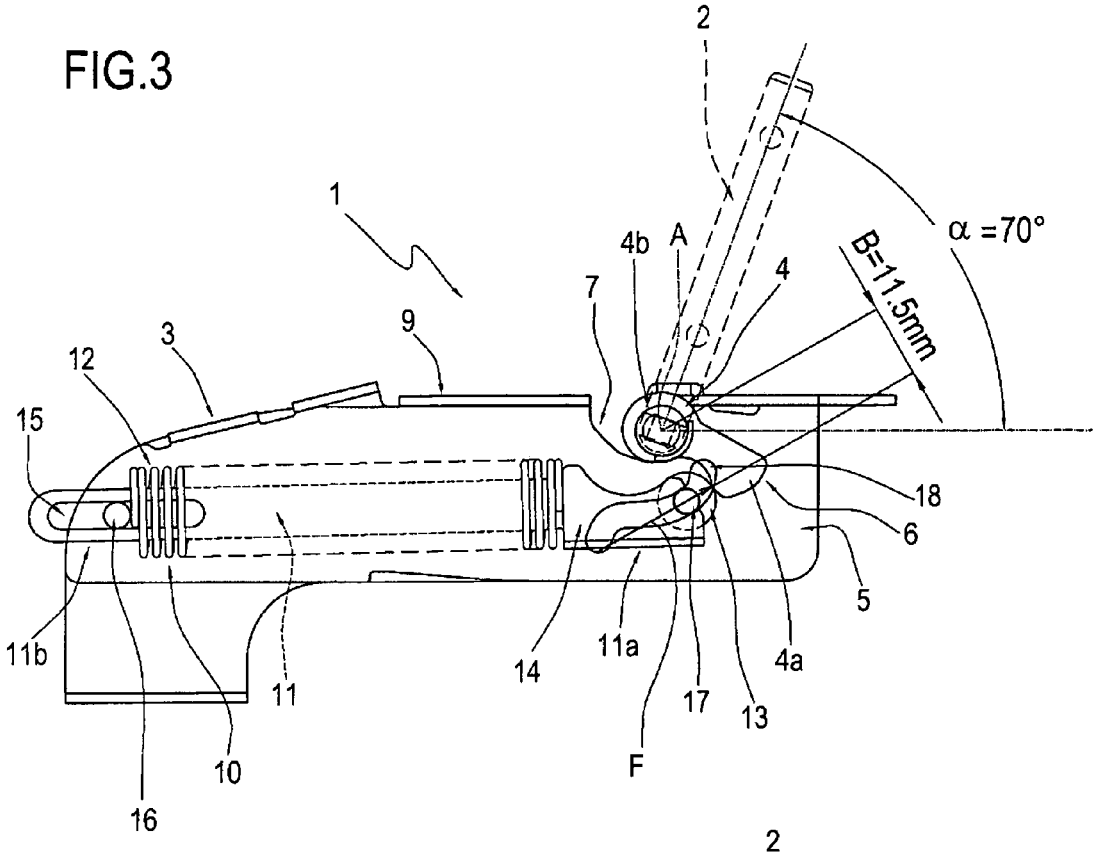
Figure 4:
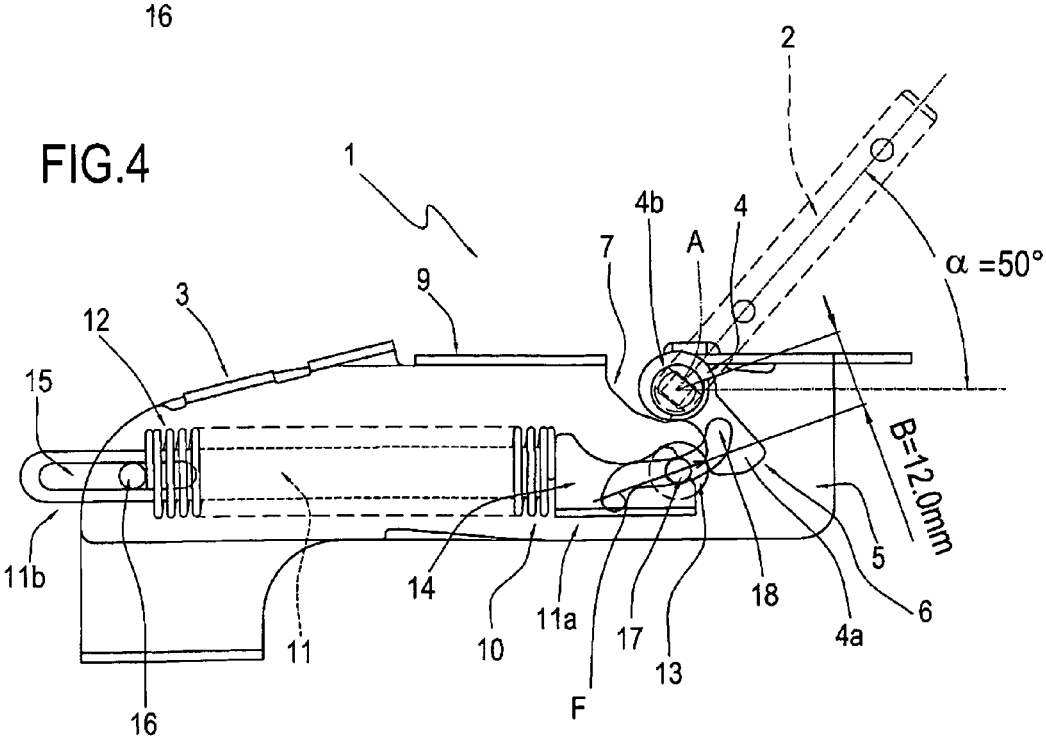
Figure 5:
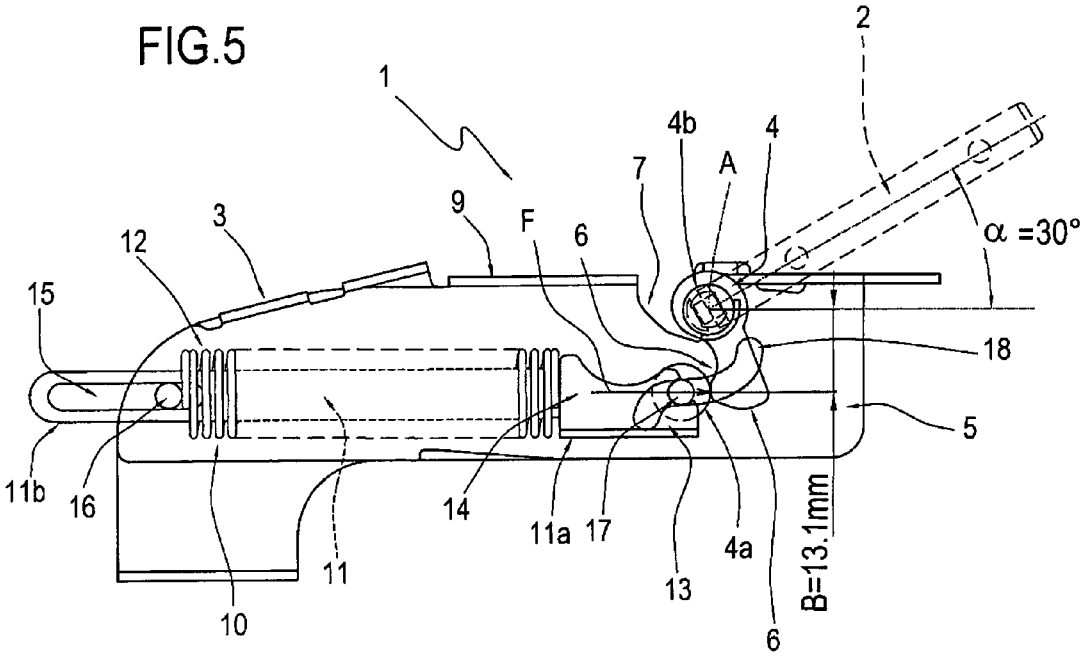
Figure 6:
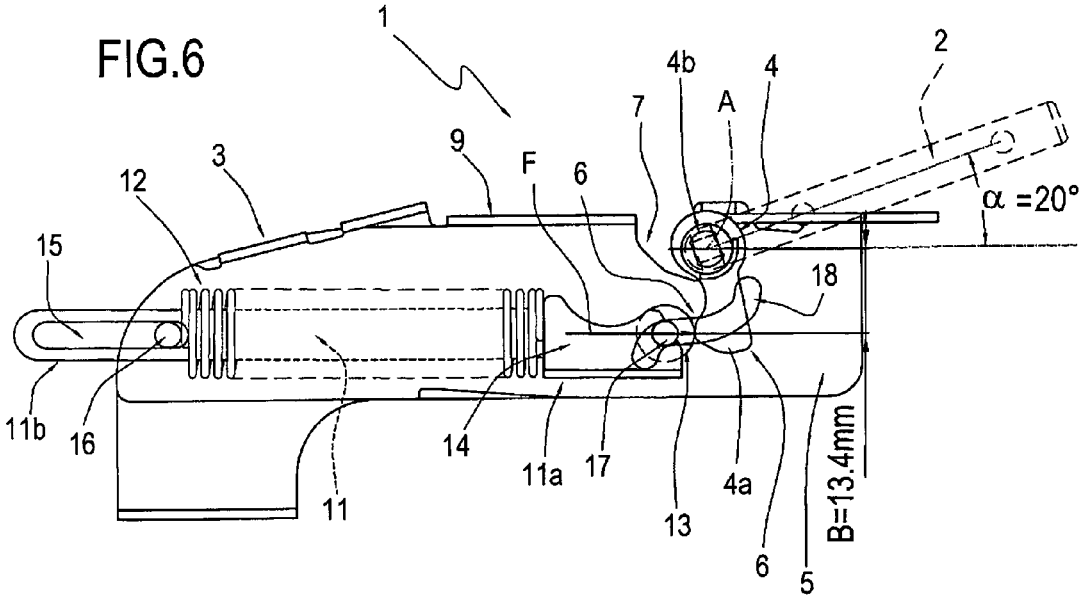
Figure 7:
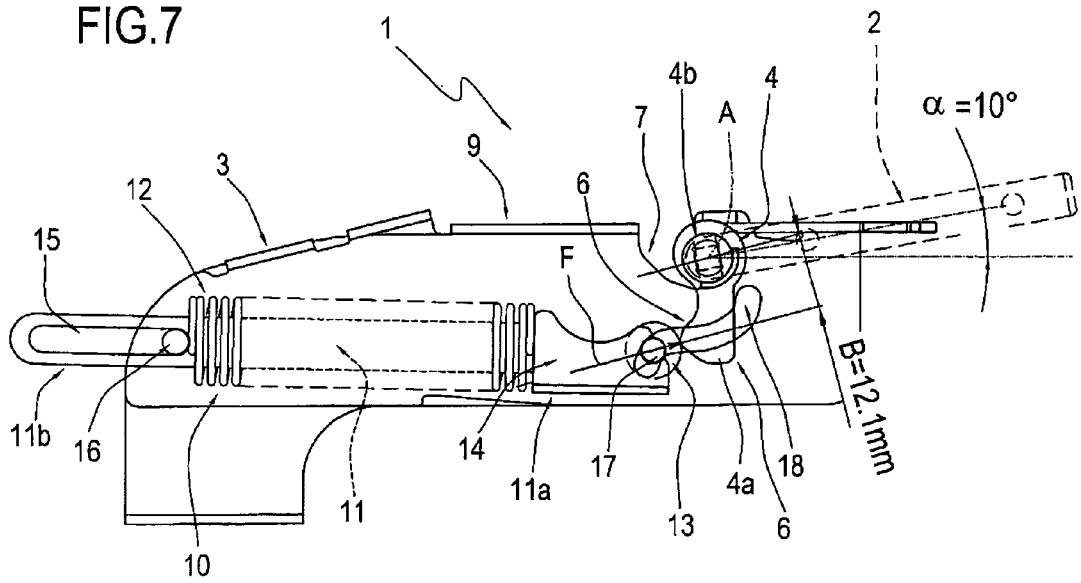

In the accompanying drawings the numeral 1 denotes as a whole a hinge for wings or doors.

The hinge 1 is particularly suitable for mounting on an electrical appliance and, in particular, on a top loading washing machine, not illustrated.

In the known way, not illustrated, the top loading washing machine comprises a casing, or frame, to the sides of which a door—also not illustrated—is connected by two hinges 1 which allow it to rotate by tilting about a horizontal axis.

Each of the two hinges 1 comprises a bracket 2 intended to support a respective side of the door, a box-shaped body 3, intended to be supported and completely enclosed by a respective side of the above-mentioned casing which is not illustrated, and a connecting lever 4, which kinematically connects the bracket 2 and the box-shaped body 3 to each other.

The box-shaped body 3 has two lateral sides 5, parallel with each other, which rotatably support the connecting lever 4.

The lever 4 comprises a first portion 4*a*, forming a respective cam 6, which is described in detail below, and a second portion 4*b*.

The first portion 4*a* of the lever 4 forms a rotation pin by means of which the lever 4 pivots at two seats 7 made respectively on each of the sides 5 of the box-shaped body 3 so that the lever 4 and the box-shaped body 3 can move relative to each other tilting about the central axis A of the pin 4*a*.

Once the door has been connected to the casing of the electrical appliance by the two hinges 1, the axes A of the hinges form the axis about which the door can rotate by tilting relative to the casing.

Figure 8:
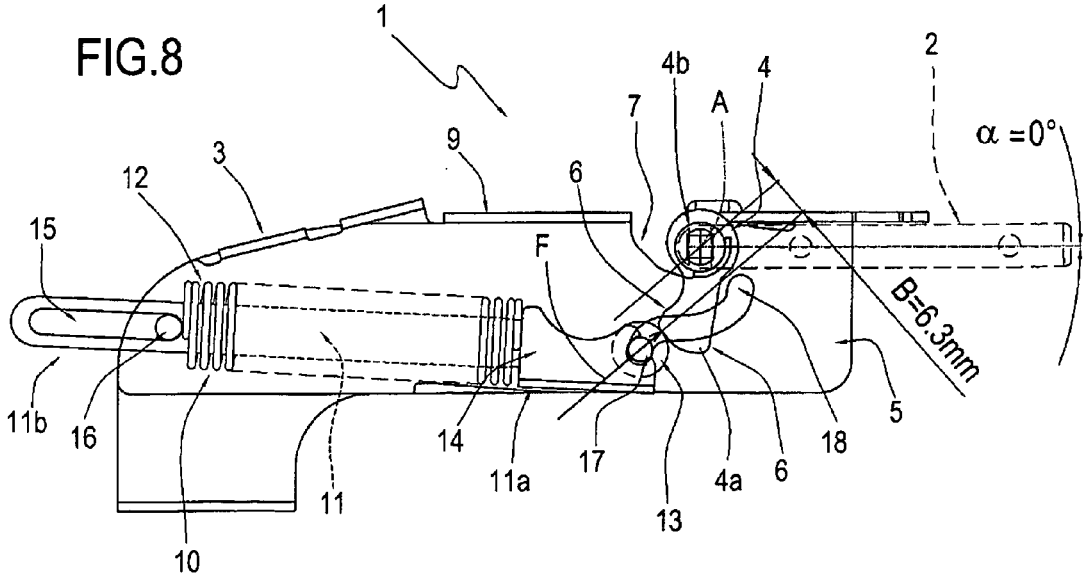
Figure 9:
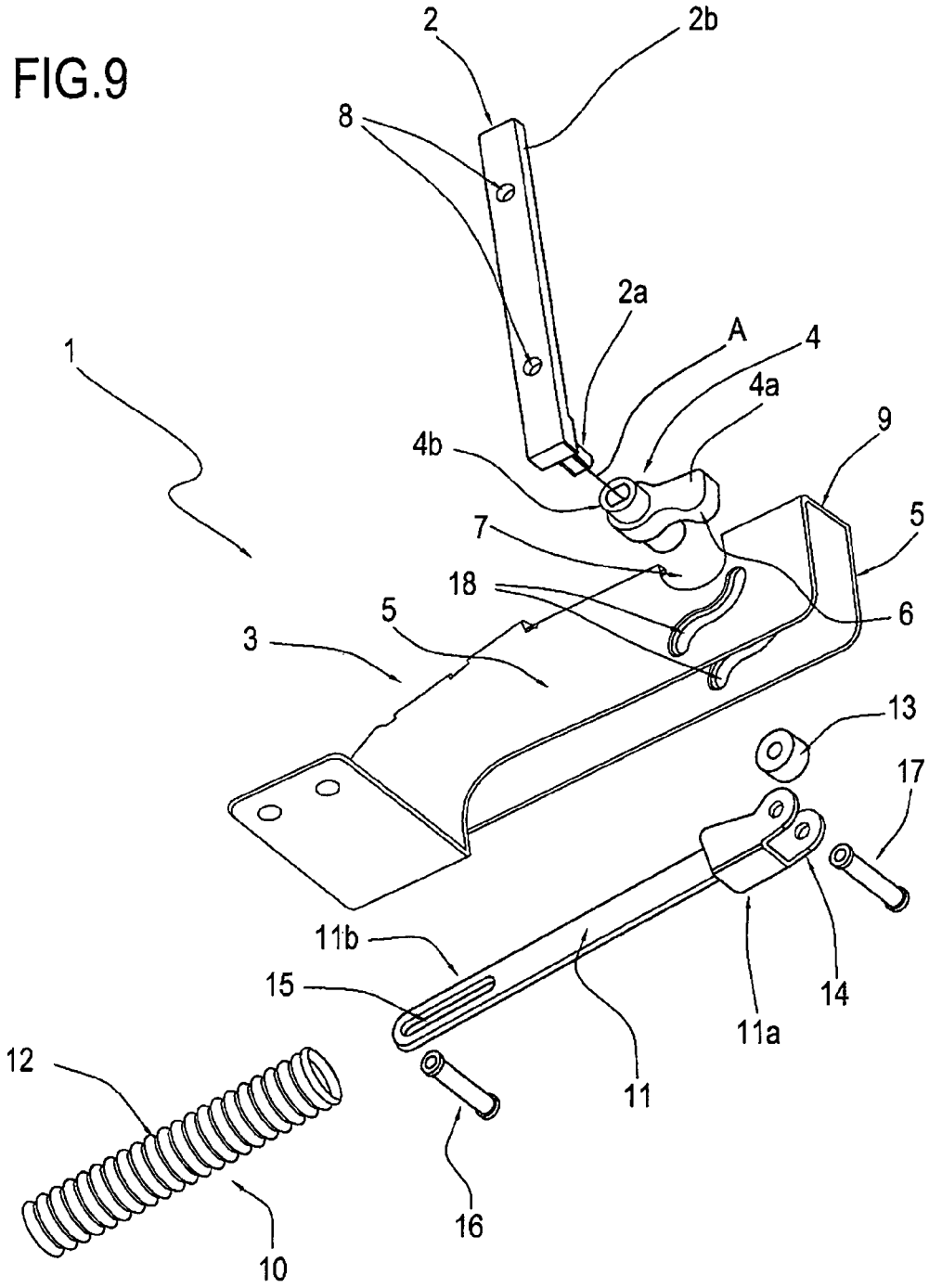
FIG. 9 is an exploded schematic view of the hinge from the previous figures.

The mechanical connection between the lever 4 and the door is made using the bracket 2, illustrated with a dashed line in FIGS. 1 to 8 and with a continuous line in FIG. 9.

The bracket 2 is L-shaped and has a first tab 2*a*, fixed to the second portion 4*b* of the lever 4, and a second tab 2*b*, extending at a right angle from the first tab 2*a*, the second tab 2*b* having a plurality of through-holes 8 so that it can be fixed using screws—not illustrated—to a respective side of the door, also not illustrated.

Suitably shaped cavities made in the pin 4*b* on both sides form respective housings for the end of the first tab 2*a* of the bracket 2.

The presence of the two opposite housings guarantees use of the hinge 1 as a right-hand or a left-hand hinge.

In addition to the sides 5, the box-shaped body 3 comprises a wall 9 connecting the sides 5 bridge-style, whilst it is open at the bottom, opposite the wall 9.

Between the sides 5, the box-shaped body 3 contains elastic means 10 designed to operate in conjunction with the first portion 4*a* of the lever 4 to adjust the motion of the lever 4 relative to the box-shaped body 3. The profile of the first portion 4*a* forms the above-mentioned cam 6.

The elastic means 10 comprise a rod 11, a helical spring 12 wound coaxially around the rod 11 and a wheel 13 for contact with the cam 6, rotatably supported by a fork 14 positioned at a first longitudinal end 11*a* of the rod 11.

The contact wheel 13 forms a follower designed to engage along the profile of the cam 6.

At its second longitudinal end 11*b*, opposite the first end 11*a*, the rod 11 has an extended slot 15, slidably connected to a first pin 16 fixed on the sides 5 of the box-shaped body 3.

The helical spring 12 is pre-compressed and is inserted between the fork 14 and the first pin 16.

The wheel 13, supported by the fork 14, is connected to the latter by a second pin 17 which has respective opposite end portions extending beyond the fork 14 and which slidably engage on respective guides 18 made on the sides 5 of the box-shaped body 3.

The guides 18, in which the end portions of the second pin 17 slide, define the path for the wheel 13 after rotation of the connecting lever 4 and the action which the latter exerts on the wheel 13.

FIG. 1 illustrates the hinge 1 in a first angular limit position in which the door connected to it is open, whilst FIG. 8 illustrates the same hinge 1 in a second angular limit position in which the door is closed.

The reference for the angular movement of the door, and therefore of the bracket 2, is the position adopted by the latter in the second, closed limit position. In other words, said position is assigned a zero value for the angle α, whilst, in the first, door open position, illustrated in FIG. 1, the same angle α is, for example, around 93°.

In practice, after rotation of the door, that is to say, of the brackets 2 about the respective axes A, the elastic thrust force exerted by the spring 12 acts on the lever 4 with a lever arm B which varies according to the angular position of the bracket 2 and therefore of the lever 4.

In particular, the action of the spring 12 is variable and in agreement with that of the operator during the door opening step, whilst it is variable and opposing during the closing step, said closing step being exemplified by the succession of configurations illustrated in FIGS. 1 to 8. The variability of the action of the spring 12 is defined by the geometry of the lever 4, that is to say, by the distance of the pins 4*b* and 17, and by the geometry of the elastic means 10.

Thus, FIGS. 1 to 8 show a plurality of positions of the bracket 2, and of the lever 4 which is integral with it, respectively corresponding to the door maximum opening position, six intermediate opening positions and, in FIG. 8, the door closed position.

The presence of the cam 6 means that the contact point with the wheel-type follower 13, which is also the point for application of the spring 12 elastic reaction force F, and therefore the force F arm B, varies according to the angle α of rotation of the lever 4 about its axis A.

In particular, the cam 6 profile is shaped in such a way that, when the door is nearly closed, that is to say, close to the zero value of the angle α as illustrated in FIG. 8, the force F arm B is suddenly reduced so as to equally rapidly reduce the moment of the elastic reaction force F acting on the lever 4, relative to the axis A.

Thanks to the above-mentioned shape of the cam 6 and to the effect derived, i.e.: the reduction of the force F moment, the following advantage is achieved: on one hand it is possible to balance the door opening/closing movement for most of its angular stroke and, on the other hand, it is possible, during closing, to have a force exerted by the door itself—that is to say, its weight force—which helps the door to close and facilitates activation of an electromechanical safety switch, if present.

In other words, the sudden reduction of the force F arm, and therefore of the torque acting on the lever 4 relative to its pivoting axis A, causes a simultaneous reduction of the balancing action exerted by the hinge 1 on the door and, consequently, for angles α close to the value zero, that is to say, close to the door closed position, the weight force of the door can usefully co-operate in the activation of the electromechanical switch located on the electrical appliance.

For example, with reference to the preferred embodiment illustrated, the table below shows the values of the force F arm B corresponding to the various angles α of opening for the door, and therefore the bracket 2, as illustrated in FIGS. 1 to 8.

| α | B |
|---|---|
| 90° | 9.6 mm |
| 70° | 11.5 mm |
| 50° | 12 mm |
| 30° | 13.1 mm |
| 20° | 13.4 mm |
| 10° | 12.1 mm |
| 0° | 6.3 mm |

Said example should be considered indicative of the reduction of the length of the arm B from 12.1 mm to 6.3 mm between the value 10° and the value 0° of the angle α, a reduction quantifiable in percentage terms as greater than 40%.

Advantageously, according to embodiments of the present invention not illustrated, said percentage reduction is achieved within an arc not greater than 5 sexagesimal degrees and, preferably, of around 2-3 sexagesimal degrees.

What is claimed is:

1. A hinge for doors, comprising:

a box-shaped body;

a lever pivoting at the box-shaped body at a respective axis of rotation so that the body and the lever can move relative to each other by tilting; and a spring mechanism housed in the box-shaped body and designed to operate in conjunction with a first portion of the lever to adjust the motion of the lever and the box-shaped body relative to each other, the spring mechanism comprising a contact element for transmitting an elastic reaction force to the first portion of the lever, wherein the first portion of the lever forms a cam and the contact element forms a follower, the cam having a profile such that the elastic reaction force application arm is varied during rotation of the lever about its axis, wherein the hinge has a first angular limit position in which a door connected to the hinge is open, and a second angular limit position in which the door is closed, and is movable between the first and second angular limit positions, and wherein the profile of the cam is such that, when the second, door closed position is almost reached, the elastic reaction force application arm is reduced down to a minimum value coinciding with the second position itself;

and further comprising a guide element forming a guide path, the guide element interacting with the contact element to constrain movement of the contact element to along the guide path; the guide path having a first portion and a second portion, the first portion corresponding to a range of movement of the hinge between closed and nearly closed, the second portion corresponding to a range of movement of the hinge between nearly closed and nearly open;

wherein the second portion of the guide path is generally aligned with a spring force direction of the spring mechanism and the first portion of the guide path angles away from alignment of the second portion of the guide path such that the first portion of the guide path reduces a compressive effect of the lever on the spring mechanism by causing the spring mechanism to pivot at a greater rate while moving along the spring force direction at a lesser rate, as compared to the second portion of the guide path.

2. The hinge according to claim 1, wherein the profile of the cam is such that, when the second, door closed position is almost reached, the elastic reaction force application arm is reduced by more than 40% of its length during an angular rotation of no more than 10 sexagesimal degrees.

3. The hinge according to claim 2, wherein the profile of the cam is such that, when the second, door closed position is almost reached, the elastic reaction force application arm is reduced by more than 40% of its length during an angular rotation of no more than 5 sexagesimal degrees.

4. The hinge according to claim 1, wherein the follower is of the wheel type.

5. The hinge according to claim 1, wherein the cam has a concave portion designed to at least partly house the follower, at least at one of the two angular limit positions of the door.

6. An electrical appliance comprising at least one hinge made in accordance with claim 1.

7. A hinge for doors, comprising:

a box-shaped body;

a lever pivoting at the box-shaped body at a respective axis of rotation so that the body and the lever can move relative to each other by tilting; and a spring mechanism housed in the box-shaped body and designed to operate in conjunction with a first portion of the lever to adjust the motion of the lever and the box-shaped body relative to each other, the spring mechanism comprising a contact element for transmitting an elastic reaction force to the first portion of the lever, wherein the first portion of the lever forms a cam and the contact element forms a follower, the cam having a profile such that the elastic reaction force application arm is varied during rotation of the lever about its axis, wherein the hinge is movable between a first angular limit position in which a door connected to it is open and a second angular limit position in which the door is closed, and wherein the profile of the cam is such that, when the second, door closed position is almost reached, the elastic reaction force application arm is reduced down to a minimum value coinciding with the second position itself, and the elastic reaction force application arm is reduced by more than 40% of its length during an angular rotation of no more than 10 sexagesimal degrees;

and further comprising a guide element forming a guide path, the guide element interacting with the contact element to constrain movement of the contact element to along the guide path; the guide path having a first portion and a second portion, the first portion corresponding to a range of movement of the hinge between closed and nearly closed, the second portion corresponding to a range of movement of the hinge between nearly closed and nearly open;

wherein the second portion of the guide path is generally aligned with a spring force direction of the spring mechanism and the first portion of the guide path angles away from alignment of the second portion of the guide path such that the first portion of the guide path reduces a compressive effect of the lever on the spring mechanism by causing the spring mechanism to pivot at a greater rate while moving along the spring force direction at a lesser rate, as compared to the second portion of the guide path.

8. The hinge according to claim 1, wherein the guide path further comprises a third portion corresponding to a range of movement of the hinge between nearly open and open;

wherein the third portion of the guide path angles away from alignment of the second portion of the guide path such that the third portion of the guide path reduces a compressive effect of the lever on the spring mechanism by causing the spring mechanism to pivot at a greater rate while moving along the spring force direction at a lesser rate, as compared to the second portion of the guide path.

9. The hinge according to claim 8, wherein the first portion of the guide path and the third portion of the guide path angle away from opposite sides of the second portion of the guide path.

10. The hinge according to claim 9, wherein the guide path is a generally s-shaped slot in the body for receiving a pin associated with the contact element.

11. The hinge according to claim 10, wherein the guide path includes two generally s-shaped slots on opposite sides of the body for receiving opposite ends of the pin associated with the contact element.

* * * * *